US006117249A

United States Patent [19]

Erikson et al.

[11] Patent Number: 6,117,249

[45] Date of Patent: Sep. 12, 2000

[54] TREATING METALLIC MACHINE PARTS

[75] Inventors: Keith W. Erikson, Hollis; Kenneth W. Erikson, Amherst, both of N.H.

[73] Assignee: Kerk Motion Products, Inc., Hollis, N.H.

[21] Appl. No.: 09/023,179

[22] Filed: Feb. 13, 1998

[51] Int. Cl.[7] ..... C21D 1/06; C23C 8/44; C23C 8/48

[52] U.S. Cl. ..... 148/226; 148/206; 148/217; 148/230; 148/238

[58] Field of Search ..... 148/219, 211, 148/226, 225, 220, 206, 212, 217, 230, 238

[56] References Cited

U.S. PATENT DOCUMENTS

| | | |
|---|---|---|
| 3,720,547 | 3/1973 | Melotik . |
| 3,793,208 | 2/1974 | Foreman . |
| 3,969,152 | 7/1976 | Melotik . |
| 4,011,361 | 3/1977 | Vassiliou et al. . |
| 4,013,487 | 3/1977 | Ramqvist et al. . |
| 4,030,405 | 6/1977 | Aldinger et al. . |
| 4,051,275 | 9/1977 | Forestek . |
| 4,074,011 | 2/1978 | Teramae et al. . |
| 4,145,326 | 3/1979 | Blackwell . |
| 4,343,661 | 8/1982 | Rice . |
| 4,448,611 | 5/1984 | Grellet et al. . |
| 4,517,248 | 5/1985 | Kik et al. . |
| 4,717,429 | 1/1988 | Kunst et al. . |
| 4,729,770 | 3/1988 | Higgins . |
| 4,880,477 | 11/1989 | Hayes et al. . |
| 5,019,182 | 5/1991 | Arimi et al. ..... 148/219 |
| 5,069,974 | 12/1991 | Silverman et al. . |
| 5,250,356 | 10/1993 | Batzar . |
| 5,344,494 | 9/1994 | Davidson et al. . |
| 5,456,723 | 10/1995 | Steinemann et al. . |
| 5,486,414 | 1/1996 | Roberto et al. . |
| 5,571,017 | 11/1996 | Niznick . |
| 5,865,021 | 2/1999 | Duerigen et al. . |

FOREIGN PATENT DOCUMENTS

| | | |
|---|---|---|
| 0 497 663 A1 | 8/1992 | European Pat. Off. . |
| 0 523 298 A1 | 1/1993 | European Pat. Off. . |
| 2 404 142 | 4/1979 | France . |
| 2 758 284 | 7/1998 | France . |
| 54 743 | 2/1969 | Germany . |
| 196 44 693 A1 | 4/1998 | Germany . |

*Primary Examiner*—Deborah Yee
*Attorney, Agent, or Firm*—Hamilton, Brook, Smith & Reynolds, PC

[57] ABSTRACT

A method of treating a metallic machine part to increase wear life and to change surface appearance comprising the steps of roughening the surface, thereafter changing its color by case hardening and, subsequently, increasing the lubricity of the case hardened surface by coating the surface with a pigmented, solid perfluorinated lubricant of a color comparable to the color of the case hardened surface.

21 Claims, 1 Drawing Sheet

TREATING METALLIC MACHINE PARTS

BACKGROUND OF THE INVENTION

The present applicants have been issued a number of patents relating to anti-backlash nut assemblies. Three such patents are U.S. Pat. Nos. 4,131,031, 4,210,033 and 5,027,671. Basically, each patent discloses a rotatable lead screw with an anti-backlash nut assembly mounted on it. The nut assembly has internal threads which mesh with the threads of the lead screw. The nut, which drives a load, traverses the lead screw as the screw is rotated, alternatively, clockwise and counter clockwise.

The nut assembly is generally formed in two parts which are urged by pressure means to maintain their threads in constant contact with the threads of the lead screw regardless of the direction of rotation. Suffice it to say, the construction reduces the occurrence of backlash.

The lead screw is usually made of metal and the nut assemblies, on the other hand, are generally constructed of plastic material such as thermoplastic moldable polymers. Such polymers include, but are not limited to, acetyl, nylon, Delrin and the like. Since the nut assembly is more complicated to manufacture than the lead screw, it is desirable that the wear of the threads of the nut be less than that of the lead screw and held to a minimum. To reduce nut wear, it is normal to coat the lead screw with low friction plastic such as polytetrafluoroethylene (PTFE). This increases lubricity and reduces the coefficient of friction and hence, drag, between the screw and the nut assembly, thus reducing thread wear of both.

A problem associated with such coated lead screws is the adhesion of the coating. Adhesion is a function of the degree of roughness which is generally accomplished by grit blasting the surface prior to coating. Generally speaking, however, the degree of roughening is maintained at a low level to counteract nut wear, but enough to insure adequate adhesion. However, the process of roughening is not without its own problems. It is not as effective with hard material as it is with soft. Example: a previously case hardened part is not particularly receptive to grit blasting.

Conversely, wear tests between thermoplastic composites against metals with varying surface finishes have shown that wear rate of the plastic part decreases as hardness of the metal increases. It has also been shown that the wear rate of PTFE lubricated thermoplastics is dependent upon forming a thin film of PTFE lubricant on both the metal and the plastic i.e., on the interface between them. However, rough surfaces on the metal, as distinguished from hard surfaces, abrade the plastic composite rapidly, not unlike a metal file on a piece of soft wood or plastic. The result is the lubricating film is not formed. Conversely, little or no lubricating material is found if the surfaces are extremely smooth.

Another situation involving the coating of the lead screw results in negative cosmetic effects. A soft or lightly adhered coating has some spreading ability not unlike fluid lubricants, however, chips, voids and scratches develop over a period of time. While they do not appreciably affect the performance, they do result in the lead screws appearing to be worn out which is often a concern to users. Furthermore, when the lead screws are not made of stainless materials, an additional problem of corrosion occurs when the coating deteriorates or for some reason is chipped or scratched off. It is to these problems that this invention is directed.

SUMMARY OF THE INVENTION

The invention resides in a method of treating metallic machine parts to increase wear life and to change surface appearance. The invention will be illustrated with regard to a rotatable lead screw with an anti-backlash nut assembly mounted on it. It will be understood, however, that the invention may be embodied in many different machine parts without departing from the scope of the invention.

The screw is initially degreased or otherwise cleaned by conventional cleaning processes to put it in condition to accept a lubricating coating as, for example, polytetrafluorethylene or other low friction polymers. The next step in the process is to create surface roughness with indentations in the surface. This may be performed by impinging particles against the surface as, for example, shot blasting using glass beads, aluminum oxide, walnut shells or the like. Chemical etching is another acceptable process. The degree of roughening is maintained at a sufficient level to limit wear of other parts frictionally engaging it but enough to ensure adequate adhesion of the lubricating polymers.

The next step in the process, but before the part is coated with the lubricating polymer, is to case harden and darken the part. This is accomplished by one of various case hardening processes which may include carburizing as, for example, pack carburizing, gas carburizing or liquid carburizing. Another technique is carbon nitriding. The preferred embodiment, however, is salt bath nitriding. Not only does this process produce a case hardened surface but it changes the color of the surface, i.e., it darkens or blackens the surface.

The next step is to increase lubricity of the roughened surface by coating it and filling the depressions made in the roughening process as well as coating the overall surface with a pigmented, dark colored, solid, pluerofluorinated lubricant such as PTFE. The result is that the wear life of the part is increased and, by employing a polymer coating having a dark pigment when parts of the coating wear off, the part does not become particularly noticeable because of the darkened case hardened surface that is compatible with the color of the coating is exposed.

The above and other features of the invention including various and novel details of construction and combination of parts will now be more particularly described with reference to the accompanying drawings and pointed out in the claims. It will be understood that the particular method of treating metallic machine parts embodying the invention is shown by way of illustration only and not as a limitation of the invention. The principles and features of this invention may be employed in varied and numerous embodiments without departing from the scope of the invention.

BRIEF DESCRIPTION OF THE DRAWINGS

FIG. 1 represents a section of the lead screw thread surface without any treatment other than cleaning.

FIG. 2 represents the same section of the lead screw but showing its surface after it has been grit blasted with abrasive particles being forcibly impinged on the surface or by other surface roughening techniques.

FIG. 3 represents the lead screw after the roughened surface has been coated and darkened by case hardening.

FIG. 4 represents the lead screw on which the lubricity of the case hardened surface has been increased by the application of a pigmented solid perfluorinated lubricant.

DETAILED DESCRIPTION OF THE INVENTION

Figure 1:
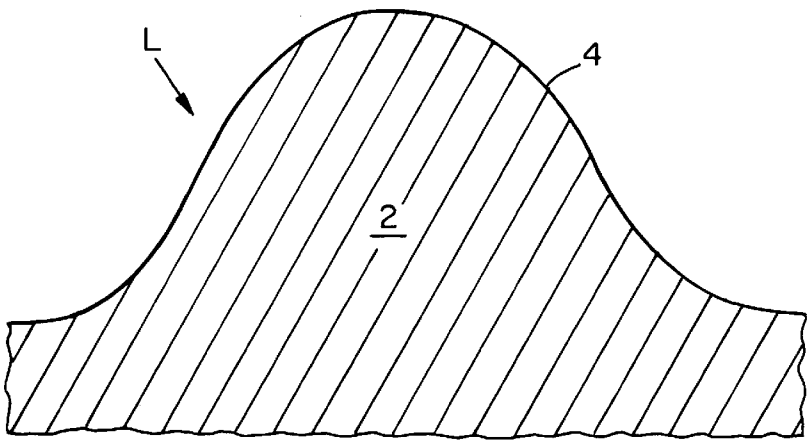
FIGS. 1–4 are greatly enlarged sections taken through one of the threads of an illustrative lead screw. The figures collectively represent a series of progressive operation steps performed on the thread.

Referring first to FIG. 1, a greatly enlarged cross-section of a part of one thread 2 of a lead screw L will be seen having a relatively smooth, although machined, exterior surface 4. The lead screw has been formed either by a conventional machine screw cutting process or by thread rolling. The lead screw may, for example, be made of 303 stainless. It will be understood, however, that other materials may be used, for example, carbon steel, particularly in light of the advantages of the herein to be disclosed inventive process. The screw is degreased and otherwise cleaned by conventional cleaning processes. The screw is not pre-hardened.

It will be understood that the invention is illustrated with respect to lead screws. It is equally applicable to other machine parts, such as guide rails or like elements where there is relative frictional motion as, for example, in our U.S. Pat. No. 4,566,345.

Figure 2:
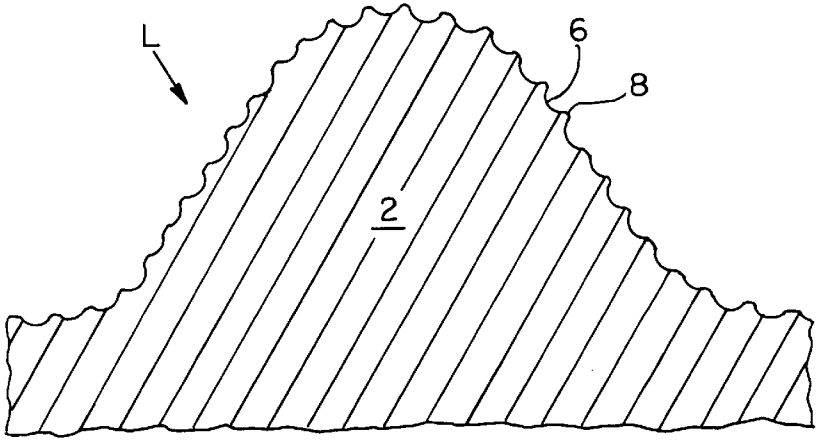

The next step is shown with reference to FIG. 2. The untreated and unhardened lead screw is roughened. It is illustrated as having indentations or depressions 6 and elevated portions 8 which essentially are parts of the original surface 4. The roughness is created by impinging particles against the surface. This step is better performed with softer steel than hardened steel to take advantage of the mechanical impinging. More specifically, grit blasting has been found advantageous. Glass beads of about 200 grit are propelled in an air stream at approximately 90 cubic C.F.M. feet at 80 p.s.i. against the surface of the screw 50 create a satisfactory roughness of about a 32 micron finish. Other forms of roughening the surface could be employed such as blasting with particles of aluminum oxide or walnut shells. The purpose of this step is to form a surface which is conducive to coating with PTFE of relatively light adherence. This step may also be performed by conventional chemical etching.

After roughening, the lead screw is cleaned of all residual particles of grit or other foreign matter, as for example, by airblasting, brushing, vacuuming or the like.

Figure 3:
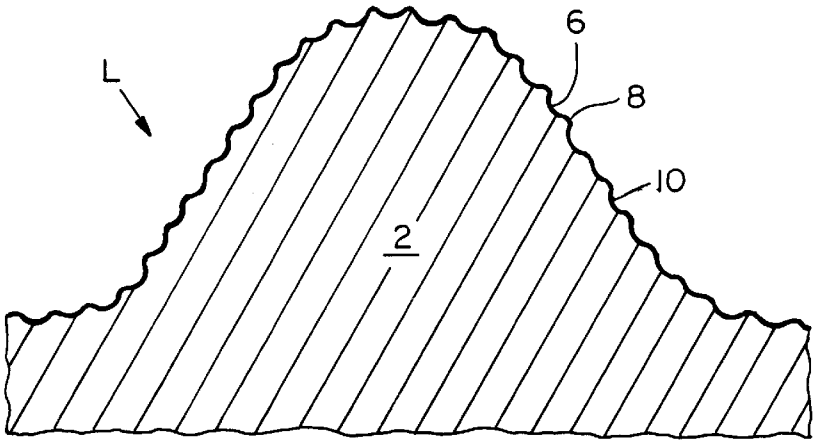

The next step in the process and illustrated in FIG. 3 is case hardening the surface of the screw. Case hardening, or surface hardening as it is sometimes called, is a process of treating soft and ductile articles to give them a very hard exterior surface or case. There are a number of techniques for case hardening, one being carburizing. In this process, a high carbon surface layer is imparted to the object, generally low carbon steel by heating the article in contact with a carbon rich atmosphere. Carburizing can be accomplished by three general techniques. One technique is pack carburizing which, broadly speaking, is accomplished by packing the steel in boxes containing carbonaceous solids. Sealing the boxes to exclude the atmosphere and heating the boxes with the articles to about 1700° F. for a period of time depending upon the depth of the case desired. 8 hours is not unusual.

Another technique is gas carburizing which is usually carried out in heated retorts that can be rotated to tumble the articles being hardened. In this case, carburizing gases are used such as carbon monoxide, propane, ethane and methane. The hydrocarbons break down giving off a large amount of carbon in the form of soot.

Liquid carburizing is performed in activated baths of calcium cyanamid, sodium/potassium cyanide and other chemicals which control the decomposition of the cyanides. These processes are followed by quenching which results in a high carbon case with a low carbon core remaining inside the article. The surface of the case is darkened by the process. The carburizing processes may be performed on stainless steel as well as low carbon steels.

Another technique is carbon nitriding which is somewhat similar to the gas carburizing process. The carburizing processes and nitrogen from dissociated ammonia and are infused into the retort during the carburizing cycle. The case contains a higher carbon content and iron nitrite, both of which contribute to the hardness such that higher hardness can be obtained.

Another technique is called salt bath nitriding. It is a thermo-chemical process in which nitrogen-bearing salts produce a controlled, uniform release of nitrogen at the surface of the workpiece. Nitrogen diffuses into and combines chemically with iron and other nitride-forming elements in the metal. This produces a tough but ductile layer that improves wear properties from two to ten-fold and increases corrosion resistance of ferrous-based materials (other than stainless steel). Fatigue strength is also generally upgraded from 20 to 100%. Normally, the process follows heat treating and finish machining and the core properties of the finished part are not affected assuming that any prior heat treatment occurred at temperatures greater than 1075° F.

The process is sometimes called salt bath ferritic nitrocarburizing. The bath comprises a mixture of cyanates and carbonates of both sodium and potassium. One such bath is a proprietary product known commercially as Kolene Nu-Tride® which is a registered trademark of the Kolene Corporation.

This process of nitrocarburizing is explained in detail in an article entitled "Salt Bath Ferritic Nitrocarburizing" by James R. Easterday, P.E. of the Kolene Corporation which article is incorporated by reference herein in its entirety.

After the nitriding step, the threads of the lead screw and any other portions of the screw which have been treated have a roughened, hardened black surface 10.

Figure 4:
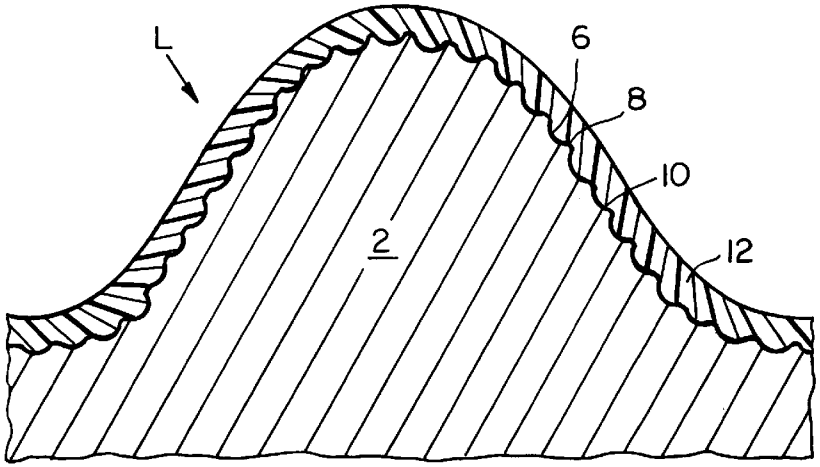

The next step in the method is to increase lubricity of the roughened surface by coating the surface and filling the depressions and overlaying the elevated portions 8 with a pigmented, solid perfluorinated lubricant such as polytetrafluorethylene shown in FIG. 4 as the coating 12. This lubricating type of coating is essentially the same color as the nitriding surface. The lead screw is now ready for assembly in machines or for shipment to customers to be assembled, etc. Because the roughening was maintained at a low level, wear on the nut is held to a minimum. However, the low level roughening is sufficient to insure minimum adhesion of the PTFE and, since the threads were hardened after grit blasting, the grit blasting per se can be conducted with far less effort and time than had the hardening step been performed before blasting. In usage, PTFE lubricant is formed depositing itself on both the metal and plastic reducing drag as well as increasing life of the parts.

Wear of the dark colored PTFE coating does not become particularly noticeable because of the dark surface of the nitrided surface of the screw that lies beneath the coating.

What is claimed is:

1. A method of treating a metallic machine part to increase wear life and to change surface appearance comprising the steps of:

creating surface roughness with indentations;

thereafter increasing the hardness and coloring the roughened surface by case hardening; and subsequently increasing lubricity of the roughened surface by coating the surface to fill the indentations and overlay the surface with a pigmented, solid perfluorinated lubricant of a color comparable to the color of the case hardened surface.

2. A method of treating a metallic machine part to increase wear life and to change surface appearance comprising the steps of:

creating surface roughness with indentations by impinging particles against the surface;

thereafter increasing the hardness and coloring the roughened surface by case hardening; and subsequently increasing lubricity of the roughened surface by coating the surface to fill the indentations and overlay the surface with a pigmented, solid perfluorinated lubricant of a color comparable to the color of the case hardened surface.

3. A method of treating a metallic machine part to increase wear life and to change surface appearance comprising the steps of:

creating surface roughness with indentations by chemical etching;

thereafter increasing the hardness and coloring the roughened surface by case hardening; and subsequently increasing lubricity of the roughened surface by coating the surface to fill the indentations and overlay the surface with a pigmented, solid perfluorinated lubricant of a color comparable to the color of the case hardened surface.

4. Method according to claim 2, wherein the step of creating surface roughness with indentations is by propelling glass beads against the surface.

5. Method according to claim 2, wherein the step of creating surface with indentations is by propelling particles of aluminum oxide against the surface.

6. Method according to claim 2, wherein the step of creating surface roughness with indentations is by propelling particles of walnut shells against the surface.

7. Method according to claim 1, wherein the case hardening step is carburizing.

8. Method according to claim 1, wherein the case hardening step is salt bath nitriding.

9. Method according to claim 2, wherein the case hardening step is carburizing.

10. Method according to claim 2, wherein the case hardening step is salt bath nitriding.

11. Method according to claim 3, wherein the case hardening step is carburizing.

12. Method according to claim 3, wherein the case hardening step is salt bath nitriding.

13. A method of treating metallic machine parts to increase wear life and to change surface appearance comprising the steps of:

roughening the surface of the part to create depressions by grit blasting the surface;

thereafter, darkening and hardening the roughened surface by case hardening;

subsequently increasing lubricity of the roughened surface by filling the indentations and coating the surface with polytetrafluorethylene of a color comparable to the color of the case hardened surface to render the surface uniformly darker than before it was roughened.

14. Method according to claim 7, wherein the step of grit blasting is by propelling glass beads against the surface.

15. Method according to claim 7, wherein the step of grit blasting is by propelling particles of aluminum oxide against the surface.

16. Method according to claim 7, wherein the step of grit blasting is by propelling particles of walnut shells against the surface.

17. Method according to claim 7, wherein the case hardening step is carburizing.

18. Method according to claim 7, wherein the case hardening step is salt bath nitriding.

19. Method according to claim 13, wherein the step of grit blasting is by propelling glass beads against the surface.

20. Method according to claim 13, wherein the step of grit blasting is by propelling particles of aluminum oxide against the surface.

21. Method according to claim 13, wherein the step of grit blasting is by propelling particles of walnut shells against the surface.

* * * * *